United States Patent [19]

Whitehead

[11] Patent Number: 4,641,123

[45] Date of Patent: Feb. 3, 1987

[54] JOYSTICK CONTROL

[75] Inventor: James M. M. Whitehead, Lindenwold, N.J.

[73] Assignee: RCA Corporation, Princeton, N.J.

[21] Appl. No.: 666,387

[22] Filed: Oct. 30, 1984

[51] Int. Cl.[4] ..... H01C 10/16

[52] U.S. Cl. ..... 338/128; 74/471 XY

[58] Field of Search ..... 338/128, 176, 133, 132; 74/471 XY

[56] References Cited

U.S. PATENT DOCUMENTS

| | | | |
|---|---|---|---|
| 3,364,454 | 1/1968 | Froebe | 338/176 |
| 3,931,606 | 1/1976 | Oka et al. | 338/132 |
| 4,281,561 | 8/1981 | Groskopfs | 338/128 X |
| 4,306,208 | 12/1981 | Coors | 336/30 |
| 4,375,631 | 3/1983 | Goldberg | 338/128 |
| 4,555,960 | 12/1985 | King | 338/128 X |

OTHER PUBLICATIONS

McGraw-Hill Dictionary of Scientific and Technical Terms; Lapedes, D. L., ed.; 1974; p. 385.

*Primary Examiner*—Harold Broome
*Assistant Examiner*—M. M. Lateef
*Attorney, Agent, or Firm*—Joseph S. Tripoli

[57] ABSTRACT

A joystick having a base and a handle. A plurality of potentiometers extending between the base and the handle so that as the handle is moved in any of six degrees of freedom, the resistance of the various potentiometers will change in a pattern which represents the movement.

5 Claims, 5 Drawing Figures

JOYSTICK CONTROL

The present invention relates to joystick controls and particularly to such controls for providing an indication of motion in any of three orthogonal directions.

BACKGROUND OF THE INVENTION

Joysticks are conventionally utilized to provide positioning information in a two dimensional system. For example, joysticks are commonly used to position objects on the screen of a video game or to manipulate a machining tool about a two-dimensional work surface.

The typical joystick, such as that shown in U.S. Pat. No. 4,375,631, issued on Mar. 1, 1983 to Thomas R. Goldberg, consists of two potentiometers coupled to a control handle. As the handle is pivoted about two orthogonal axes, the resistance of the potentiometers varies in relation to the position of the handle. The value of the resistance or the magnitude of the current passing through the potentiometer indicates the position of the joystick handle about the corresponding axis. This resistance, or current, representing the handle's position is then utilized to control some other function such as the position of the video game object or the machine tool head. The movement of the handle may be used to dynamically control the object by continuously monitoring the change in the potentiometer resistance and employing the monitored resistance to move the object in a pattern corresponding to the movement of the joystick handle.

In some applications the object to be controlled by the joystick may need to be positioned or moved in a three dimensional space or twisted about any of three orthogonal axes. In such a case, the conventional joystick which is limited to controlling movement in only two dimensions is inadequate.

SUMMARY OF THE INVENTION

A joystick according to the present invention includes a handle and a base. A plurality of potentiometers are coupled between the base and the handle so as to provide an indication through varying resistance of at least three degrees of freedom of movement by the handle with respect to the base.

DETAILED DESCRIPTION OF THE PREFERRED EMBODIMENT

Figure 1:
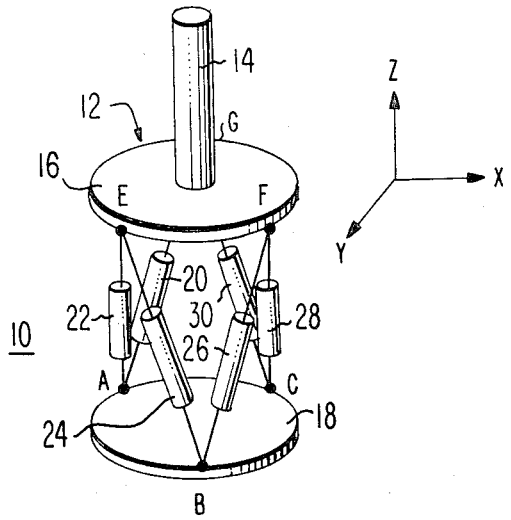
FIG. 1 is a schematic representation of one embodiment of a joystick according to the present invention.

With initial reference to FIG. 1, a joystick 10 comprises a handle 12 which consists of a cylindrical portion 14 connected to the center of a disk portion 16. The cylindrical portion 14 of the handle 12 could include some form of a hand grip on the end opposite that connected to the disk portion 16. For example, the grip could include a ball or a brass knuckle like grip having apertures through which the operator's fingers could be placed. The joystick 10 has a base 18 shown as a disk shaped object. The base, however, could be any one of a number of shapes and may comprise one surface of the enclosure for the joystick (not shown).

Extending between the base 18 and the disk portion 16 of the handle 12 are six cylindrical potentiometers 20–30. Adjacent pairs of the potentiometers are connected to the base 18 at three points A, B, and C which are equidistantly spaced around the circumference of the circular base 18. Specifically, potentiometers 20 and 22 are connected at one end to point A, one end of potentiometers 24 and 26 are connected at point B and potentiometers 28 and 30 are connected at one end to point C. Two of the potentiometers which are connected to different adjacent points A, B, or C on base 18 are connected at their other ends to one of three points E, F and G which are equidistantly spaced around the circumference of the circular disk portion 16. Specifically, potentiometers 22 and 24 are connected at their other ends to point E, the other ends of potentiometers 26 and 28 are connected to point F and potentiometers 20 and 30 are connected at the other ends to point G (hidden in the view of FIG. 1). The connection of the potentiometers to the base 18 and the disk portion 16 at points A through G permits each of the potentiometers to swivel about each connection point as the handle is moved with respect to the base.

Figure 2:
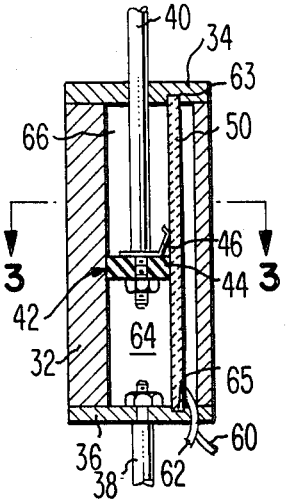
FIG. 2 is a sectional view of a potentiometer of the joystic in FIG. 1.
Figure 3:
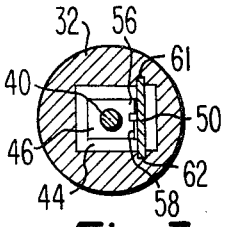
FIG. 3 is a cross sectional view of the potentiometer in FIG. 2 taken along lines 3—3.
Figure 4:
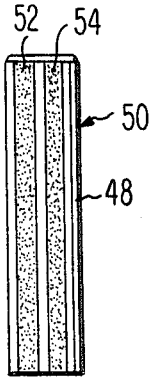
FIG. 4 is a perspective view of an element of the potentiometer in FIGS. 2 and 3.

With reference to FIGS. 2 and 3 each of the potentiometers 20–30 has a tubular cylinder 32 with a rectangular cross sectional opening extending longitudinally through the cylinder. Each end of the cylinder has an end cap 34 and 36 sealed to it by appropriate means. Located within the cylinder 32 and extending longitudinally from one end cap to the other is a resistor block 50. As shown in detail in FIG. 4, the resistor block 50 consists of an electrically insulative substrate 48 on which an electrically conductive strip 52 is deposited on one major surface of the substrate 48 in the longitudinal dimension. A second strip 54 of resistive material is also deposited on the one surface of the substrate 48 parallel to the conductive strip 52. The resistor block 50 is held in place by positioning it in grooves 61 and 62 in opposite sidewalls of the cylinder 32 and in grooves 63 and 65 in the respective end plates 34 and 36. One of two wires 60 and 62 (FIG. 2) is connected to one end of either the conductive or resistive strips 52 and 54.

Each end cap 34 and 36 has an aperture therethrough located about the longitudinal axis of the cylinder 32. A first shaft 38 has a threaded end portion extending through the aperture in the end cap 36 and fastened thereto by a nut. The other end of the shaft 38 is connected to the base 18 at one of the points A, B or C. End cap 34 has a piston shaft 40 extending through its aperture. The end 42 of the piston shaft 40 which is within the cylinder 32 has a threaded portion extending through an aperture in a rectangular rubber piston 44. The rectangular piston 44 makes contact with three of the inner sidewalls of the cylinder 32 and with the resistor block 50 to prevent an appreciable amount of air from flowing around the piston 44 as it moves within cylinder 32. The other end of the piston shaft 40 is connected to the disk portion 16 of the handle 12 at one of the points E, F or G.

Also located on the threaded portion of the piston rod 40 at end 42 is an electrically conductive wiper 46 having two spring clips 56 and 58 which contact the conductive strip 52 and the resistive strip 54, respectively. When the piston 44 moves longitudinally in the opening of cylinder 32, the conductive wiper 46 moves along the conductive and resistive strips 52 and 54 on the resistor block 50. As the wiper 46 moves, it changes the point of electrical contact between the electrically conductive strip 52 and the resistive strip 54 thereby changing the resistance between the two wires 60 and 62. This change in resistance is directly indicative of the position of the wiper 46 and the piston 44

The region 64 within the cylinder 32 between piston 44 and the end cap 36 may be a relatively airtight chamber. The inner portion 66 of the cylinder 32 between the piston 44 and the other end plate 34 is not a sealed chamber in that air may escape through the end plate 34 around the piston shaft 40. The joystick and pistons are assembled such that when no forces are applied to the joystick handle 12, the piston 44 is approximately midway along its travel within the cylinder 32 and such that the pressure within the closed chamber 64 equals the normal atmospheric pressure. The sealed chamber region 64 acts like a spring on the piston 44. Specifically, as the piston 44 is pushed toward the one end cap 36 the air pressure within the closed region 64 builds up and provides a counterforce so that when the force on the handle 12 is released the piston 44 returns to its original position. Similarly, when force is applied to the handle 12 which causes the piston 44 to move toward the other end cap 34. The air within the closed region 64 expands so as to pull the piston 44 toward its original position when the force on the handle 12 is removed. Alternatively, the region 64 of cylinder 32 could be opened to the atmosphere, such as by providing holes through the end cap 36, and a spring could be connected between the piston and one of the end caps to provide a similar return to neutral position mechanism.

With reference once again to FIG. 1 as the handle 12 is moved or twisted, the resistance of at least some of the potentiometers 20–30 will change in proportion to the direction and magnitude of the movement of the handle 12. This movement can be determined by measuring the change and the specific pattern of change of the resistance among the various potentiometers. For example, if the handle 12 is moved in the Z direction only with respect to the base 18, the resistance of each of the potentiometers will change by the same magnitude. Movement in either the X or Y direction will cause some of the potentiometers to increase in resistance and others to decrease in resistance. Not only can movement along the three orthogonal axes be determined but, also the roll, pitch, and yaw of the handle (i.e. the twisting of the handle about one of each of the three axes). The configuration of FIG. 1 enables the joystick to produce a indication of six degrees of freedom of movement (three orthogonal directions and three twisting motions). The conversion of the outputs from the various potentiometers to orthogonal coordinates can be accomplished by either hardware or software.

It will be obvious to those skilled in the art that cylindrical resistors 20 through 30 maybe replaced by other types of variable resistance devices. One such alternative device might be similar to a moving coil microphone whose resistance varies with direction and magnitude of the pressure exerted upon it. Similarly, other geometrical connections of the resistance devices between the handle 12 and the base 18 can be used to carry out the teaching of the present invention.

Figure 5:
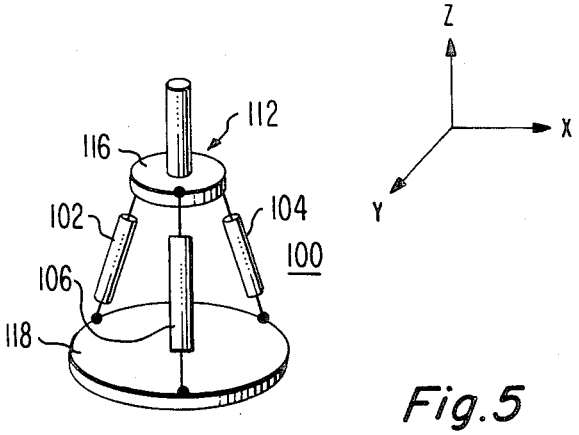
FIG. 5 is another embodiment of the present invention.

Alternatively, if the joystick need only provide an indication of movement along the three orthogonal axes (i.e. no rotational indication), a three potentiometer device 100 as shown in FIG. 5 may be used. In this embodiment the handle 112 has a disk portion 116 having a smaller diameter than a disk shaped base 118. Three potentiometers 102, 104 and 106 extend between the circumferences of the disk portion 116 and the base 118 much like the legs of a milking stool. Movement of the joystick handle 112 varies the resistance of the three potentiometers 102–106 which can be translated into movement in orthogonal coordinates.

I claim:

1. A joystick comprising:

a base;

a handle; and a plurality of potentiometers coupled between the base and the handle and directly connected thereto so as to provide at least three degrees of freedom of movement by said handle with respect to the base, the potentiometers connected to the base and handle so that said movement varies the electrical resistance of the potentiometers in relation to the direction and amount of movement.

2. The joystick as in claim 1 wherein each potentiometer comprises:

a tubular cylinder having a resistive surface in the interior of the cylinder; and a piston slideably mounted within the cylinder.

3. The joystick as in claim 2 wherein there are six potentiometers, two potentiometers being connected to the base at each of three points and different pairs of the potentiometers being connected at each of three points on the handle.

4. The joystick as in claim 3 wherein each set of three points on the base and handle are equidistantly spaced about a circle.

5. A joystick comprising:

a base;

a handle; and six potentiometers connected in pairs to three points on said handle and connected in different pairs to three points on said base so as to provide six degrees of freedom of movement by said handle with respect to said base so that the electrical resistance of said potentiometers varies corresponding to the direction and magnitude of said movement.

* * * * *